US007154225B2

(12) United States Patent
Kim et al.

(10) Patent No.: US 7,154,225 B2
(45) Date of Patent: Dec. 26, 2006

(54) SURFACE LIGHT SOURCE DEVICE, METHOD OF MANUFACTURING THE SAME AND LIQUID CRYSTAL DISPLAY APPARATUS HAVING THE SAME

(75) Inventors: Joong-Hyun Kim, Yongin-si (KR); Ki-Yeon Lee, Suwon-si (KR); Sang-Yu Lee, Yongin-si (KR); Seog-Hyun Cho, Seoul (KR); Jin-Seob Byun, Seoul (KR); Dong-Woo Kim, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 161 days.

(21) Appl. No.: 10/850,996

(22) Filed: May 20, 2004

(65) Prior Publication Data

US 2005/0046331 A1 Mar. 3, 2005

(30) Foreign Application Priority Data

Sep. 2, 2003 (KR) ..... 10-2003-0061059

(51) Int. Cl.
*H01J 17/02* (2006.01)
*H01J 61/02* (2006.01)

(52) U.S. Cl. ..... 313/609; 313/610; 313/634

(58) Field of Classification Search ..... 313/491, 313/493, 494, 610, 422, 634, 609
See application file for complete search history.

(56) References Cited

U.S. PATENT DOCUMENTS 5,466,990 A * 11/1995 Winsor ..... 315/56
6,175,187 B1 * 1/2001 Tsutsui ..... 313/493
6,674,250 B1 * 1/2004 Cho et al. ..... 315/291
6,749,315 B1 * 6/2004 Moon et al. ..... 362/97
6,787,981 B1 * 9/2004 Yoo et al. ..... 313/491
2001/0035717 A1 * 11/2001 Davenport ..... 313/560
2004/0009733 A1 * 1/2004 Fukai et al. ..... 445/26

* cited by examiner

*Primary Examiner*—Joseph Williams
*Assistant Examiner*—Bumsuk Won
(74) *Attorney, Agent, or Firm*—Cantor Colburn LLP

(57) ABSTRACT

A surface light source device includes a lamp body, a space dividing member, a discharge gas supplying member and a voltage applying part. The lamp body includes a flat shaped space and a fluorescent layer disposed in the flat shaped space to convert an invisible light into a visible light. The space dividing member divides the flat shaped space into a plurality of discharge spaces. The discharge gas supplying member is disposed to pass through the space dividing member and is fixed to the space dividing member, and supplies the discharge spaces with a discharge gas that generates the invisible light. The voltage applying part applies a discharge voltage to the discharge gas. Therefore, the lifetime of the surface light source device generating a planar light is increased, and the luminance of the light becomes uniform so that the display quality of an image is improved.

23 Claims, 21 Drawing Sheets

SURFACE LIGHT SOURCE DEVICE, METHOD OF MANUFACTURING THE SAME AND LIQUID CRYSTAL DISPLAY APPARATUS HAVING THE SAME

CROSS-REFERENCE OF RELATED APPLICATIONS

The present application claims priority from Korean Patent Application No. 2003-61059, filed on Sep. 2, 2003, the disclosure of which is hereby incorporated herein by reference in its entirety.

BACKGROUND OF THE INVENTION

1. Field of the Invention

The present invention relates to a surface light source device, a method of manufacturing the surface light source device and a liquid crystal display (LCD) apparatus having the surface light source device. More particularly, the present invention relates to a surface light source device capable of improving lifetime and optical characteristics, a method of manufacturing the surface light source device and an LCD apparatus having the surface light source device.

2. Description of the Related Art

In a liquid crystal display (hereinafter, referred to as LCD) apparatus, generally, the arrangement of liquid crystal molecules is varied in response to an electric field applied thereto, and thus a light transmittance thereof is changed.

A conventional LCD apparatus displays an image containing information by using the liquid crystal. The LCD apparatus has various merits for example, such as high luminance, high efficiency, uniform luminance, long lifetime, thin thickness, light weight and low cost and so on, so that the LCD apparatus is used for a portable computer, a communication apparatus, a television receiver set, etc.

The LCD apparatus is a light receiving type display apparatus, so that the LCD apparatus requires a light supplying part.

The light supplying part includes a plurality of cold cathode fluorescent lamps (hereinafter, referred to as CCFL) having a rod shape or a plurality of light emitting diodes (LED) having a dot shape. The CCFLs have various merits, for example, such as high luminance, long lifetime, white color and so on. The CCFLs also generate lower heat than incandescent lamps. The LEDs also have high luminance and low power consumption.

The light supplying part having the CCFLs or LEDs requires optical members such as a light guide plate (LGP), a light diffusion plate (LDP), a brightness enhancement sheet (BES), etc., because the CCFLs and LEDs don't have uniform luminance. Therefore, the volume and weight of the LCD apparatus are increased.

BRIEF SUMMARY OF THE INVENTION

The present invention provides a surface light source device capable of improving lifetime and optical characteristics.

The present invention also provides a method of manufacturing the surface light source device.

The present invention also provides an LCD apparatus having the surface light source device.

The surface light source device in accordance with an exemplary embodiment of the present invention includes a lamp body, a space dividing member, a discharge gas supplying member and a voltage applying part. The lamp body includes a flat shaped space and a fluorescent layer disposed in the flat shaped space to convert an invisible light into a visible light. The space dividing member divides the flat shaped space into a plurality of discharge spaces. The discharge gas supplying member is disposed to pass through the space dividing member, and is fixed to the space dividing member. The discharge gas supplying member supplies the discharge spaces with a discharge gas that generates the invisible light. The voltage applying part applies a discharge voltage to the discharge gas.

The method of manufacturing the surface light source device in accordance with an exemplary embodiment of the present invention is provided as follows.

A light emitting region of a second substrate is divided by a space dividing member to form a plurality of discharge regions. A discharge gas supplying member disposed to pass through the space dividing member to supply the discharge regions with a discharge gas is formed. A first fluorescent portion in a light exiting region of a first substrate corresponding to the light emitting region is formed. A sealant is disposed on a first peripheral region that surrounds the light exiting region and a second peripheral region that surrounds the light emitting region to form a lamp body. The discharge gas is supplied from the discharge gas supplying member to the discharge regions.

The LCD apparatus in accordance with an exemplary embodiment of the present invention includes a surface light source device, a receiving container and an LCD panel.

The surface light source device includes a lamp body that includes a flat shaped space and a fluorescent layer disposed in the flat shaped space to convert an invisible light into a visible light, a space dividing member that divides the flat shaped space into a plurality of discharge spaces, a discharge gas supplying member that is disposed to pass through the space dividing member, and the discharge gas supplying member is fixed to the space dividing member, and the discharge gas supplying member supplies the discharge spaces with a discharge gas that generates invisible light, and a voltage applying part that applies a discharge voltage to the discharge gas. The receiving container receives the surface light source device. The LCD panel converts the visible light into an image light including information.

Therefore, the lifetime of the surface light source device generating a planar light is increased, and the luminance of the light becomes uniform, so that the display quality of an image is improved.

BRIEF DESCRIPTION OF THE DRAWINGS

The above and other advantages of the present invention will become more apparent by describing in detail exemplary embodiments thereof with reference to the accompanying drawings, in which.

DESCRIPTION OF THE PREFERRED EMBODIMENTS

Hereinafter, the present invention will be described in detail with reference to the accompanying drawings.

Figure 1:
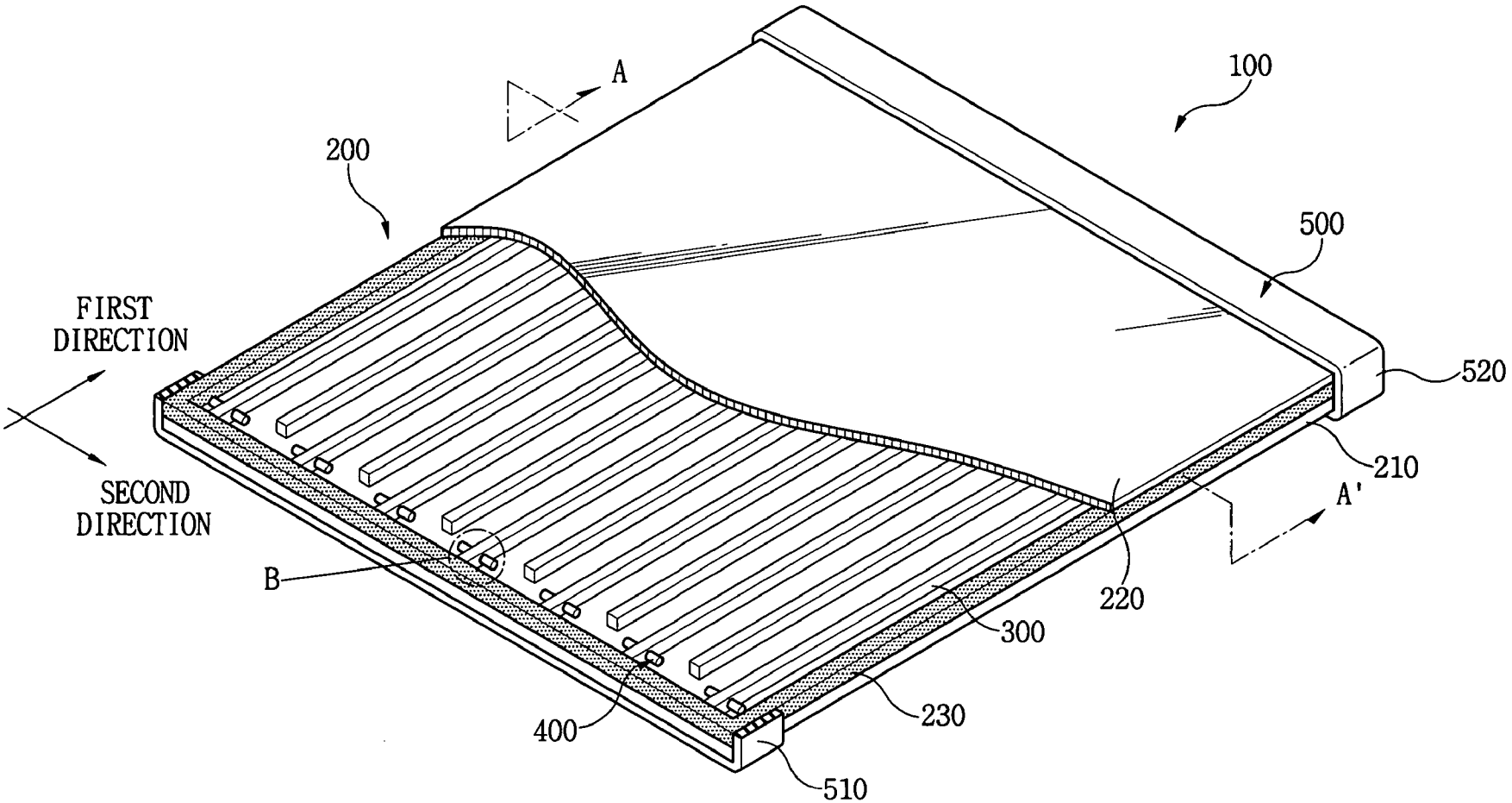
FIG. 1 is a partially cut out perspective view showing a surface light source device in accordance with an exemplary embodiment of the present invention.
Figure 2:
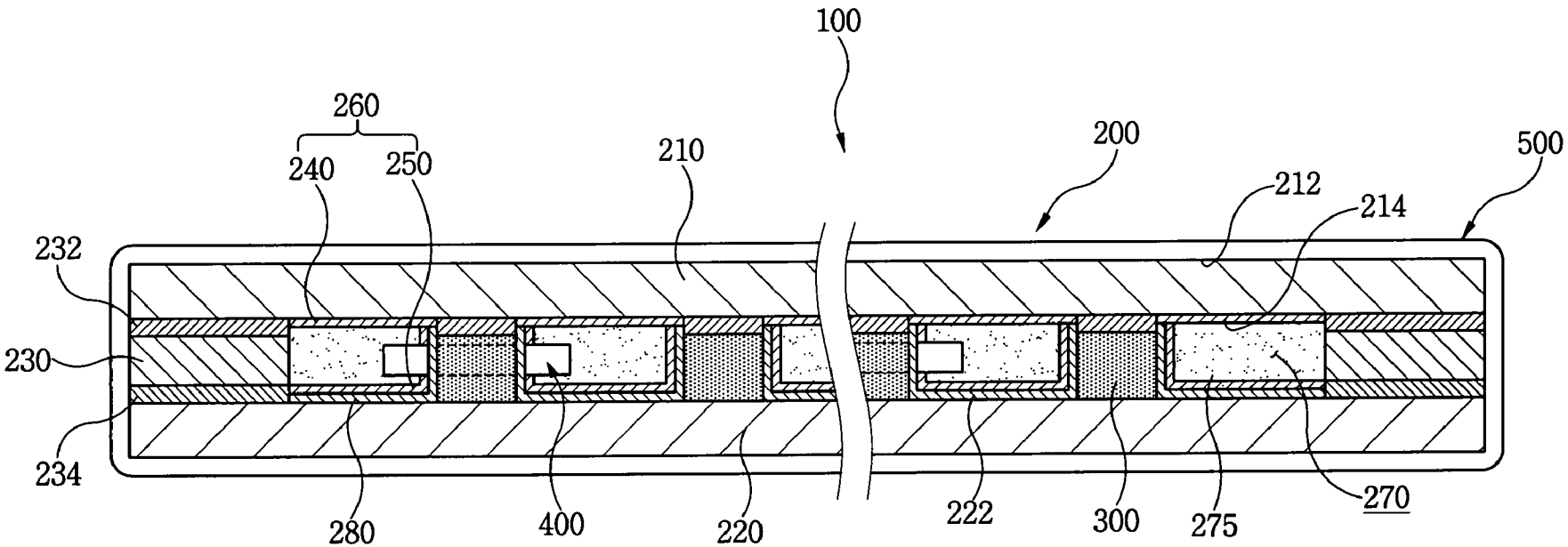
FIG. 2 is a cross-sectional view taken along a line A–A' of FIG. 1.

FIG. 1 is a partially cut out perspective view showing a surface light source device in accordance with an exemplary embodiment of the present invention. FIG. 2 is a cross-sectional view taken along a line A–A' of FIG. 1, and FIG. 3 is an enlarged view showing a portion 'B' of FIG. 1.

Figure 3:
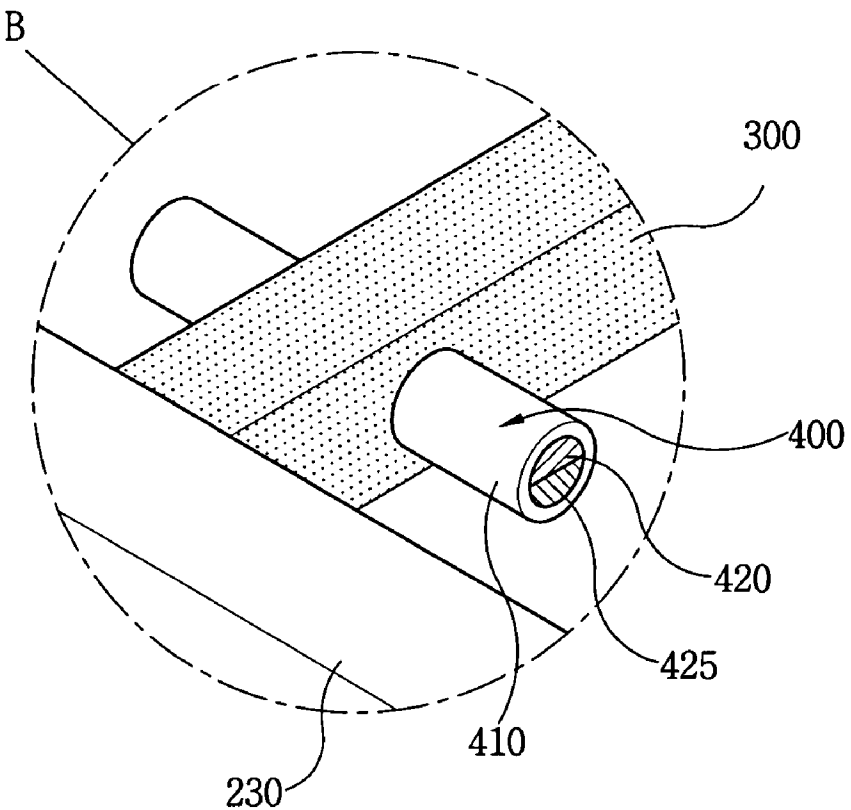
FIG. 3 is an enlarged view showing a portion 'B' of FIG. 1.

Referring to FIGS. 1 to 3, the surface light source device 100 includes a lamp body 200, a space dividing wall 300, a discharge gas supplying member 400 and a voltage applying part 500.

The lamp body 200 includes a flat shaped space and a fluorescent layer 260.

A discharge gas is contained in the flat shaped space. When a voltage is applied to the discharge gas, an invisible light is generated. Then, the fluorescent layer 260 converts the invisible light into a visible light. The invisible light may be ultraviolet light.

The lamp body 200 also includes a first substrate 210, a second substrate 220 and a sealant 230.

The first substrate 210 comprises a transparent material, and has a rectangular plate shape. The first substrate 210 may be a glass substrate having high light transmittance. The first substrate 210 includes a first face 212 and a second face 214 corresponding to the first face 212. The first face 212 emits the visible light.

The second substrate 220 comprises a transparent material, and has a rectangular plate shape. The second substrate 220 may be a glass substrate having high light transmittance. The second substrate 220 includes a third face 222 corresponding to the second face 214.

The area and shape of the first substrate 210 of the lamp body 200 are substantially equal to those of the second substrate 220. The second face 214 of the first substrate 210 is disposed corresponding to the third face 222 of the second substrate 220.

The sealant 230 comprises a transparent material such as glass. The sealant 230 has a rectangular frame shape having an opening. The sealant 230 is disposed between the first and second substrates 210 and 220, so that the flat shaped space, where the discharge gas generating the invisible light is disposed, is formed between the first and second substrates 210 and 220. The sealant 230 is disposed on an edge of the second face 214 of the first substrate 210 and an edge of the third face 222 of the second substrate 220.

A first adhesive 232 is disposed between the sealant 230 and the second face 214 of the first substrate 210, and a second adhesive 234 is disposed between the sealant 230 and the third face 222 of the second substrate 220, so that the sealant 230 seals the space between the first and second substrates 210 and 220.

The space dividing wall 300 forms at least two discharge spaces 270 in the lamp body 200. The space dividing wall 300 is disposed perpendicular to the first and second substrates 210 and 220. The space dividing wall 300 may comprise a transparent material or an opaque material.

The surface light source device 100 may include a plurality of the space dividing walls 300. The space dividing walls 300 are extended in a first direction, and arranged in a second direction substantially perpendicular to the first direction.

The fluorescent layer 260 formed on the lamp body 200 includes a first fluorescent portion 240 and a second fluorescent portion 250. The first fluorescent portion 240 is disposed on the second face 214 of the first substrate 210, and the second fluorescent portion 250 is disposed on the third face 222 of the second substrate 220. The first fluorescent portion 240 may be printed on the second face 214, and the second fluorescent portion 250 may be sprayed on the third face 222. Preferably, the second fluorescent portion 250 may also be formed on the surface of the space dividing wall 300 so as to increase the amount of the visible light exiting from the lamp body 200. When a portion of the second fluorescent portion 250 is sprayed on the space dividing wall 300, the portion of the second fluorescent portion 250 on the edge of the space dividing wall 300 may be grinded. Therefore, the portion of the second fluorescent portion 250 on the edge of the space dividing wall 300 is removed.

The first and second fluorescent portions 240 and 250 include a red fluorescent material, a green fluorescent material and a blue fluorescent material. The red fluorescent material, the green fluorescent material and the blue fluorescent material transform the ultraviolet into a red light, a green light and a blue light, respectively. Substantially same amount of the red light, the green light and the blue light generate a white light.

A light reflecting layer 280 may be further formed under the second fluorescent portion 250. The light reflecting layer 280 reflects the invisible light and the visible light generated from the discharge gas of the discharge spaces 270 toward the second face 214. The light reflecting layer 280 comprises titanium oxide ($TiO_3$) film, aluminum oxide ($Al_2O_3$) film, etc. The light reflecting layer 280 may be formed through a chemical vapor deposition (CVD) process, a sputtering process, etc. Alternatively, metal powder or liquid metal may be sprayed and fired to form the light reflecting layer 280.

When a portion of the light reflecting layer 280 is disposed on the space dividing wall 300, the portion of the light reflecting layer 280 on the edge of the space dividing wall 300 may be grinded. Therefore, the portion of the light reflecting layer 280 on the edge of the space dividing wall 300 is removed.

The discharge gas supplying member 400 is disposed in the lamp body 200. The surface light source device 100 may include a plurality of the discharge gas supplying members 400. The discharge gas supplying members 400 pass through the space dividing wall 300 in the second direction, and the discharge gas supplying members 400 are fixed to the space dividing wall 300. Alternatively, a plurality of the discharge gas supplying members 400 may correspond to each of the space dividing walls 300. Each of the discharge gas supplying members 400 may also be fixed to the odd or even numbered space dividing walls 300.

The discharge gas supplying member 400 is fixed to the space dividing wall 300 so as to prevent the drifting of the discharge gas supplying member 400 due to the vibration or impact from outside.

Referring again to FIG. 3, the discharge gas supplying member 400 includes a tube body 410 and an amalgam part 420. The tube body 410 has a tubular shape, and the outer surface of the tube body 410 is fixed to the space dividing wall 300. End portions of the tube body 410 are opened.

The amalgam part 420 comprises a titanium-mercury (Ti—Hg) alloy, and disposed inside the tube body 410. The amalgam part 420 includes a discharge gas 275 such as mercury (Hg). Electrons that move in a high speed are impacted on the mercury (Hg) so as to generate the ultraviolet light. The amalgam part 420 supplies the discharge gas 275 at a temperature ranged from about 700° C. to about 900° C. In order to supply the discharge gas 275 from the amalgam part 420, the amalgam part 420 is heated by a radio frequency. The discharge gas 275 may also include krypton (Kr), xenon (Xe), argon (Ar), neon (Ne), etc. The amount of the discharge gas 275 supplied from the amalgam part 420 to each of the discharge spaces 270 is ranged from about 1 mg to about 5 mg.

When the amount of the supplied discharge gas 275 in each of the discharge spaces 270 is different from one another, the amount of the light generated in the discharge spaces 270 is also different from one another. Therefore, the brightness of the surface light source device 100 may not be uniform. The variation of the discharge gas 275 in each of the discharge space 270 is decreased by a space formed in the tube body 410. The space of the tube body 410 connects the discharge spaces 270 divided by the space dividing walls 300 so that the discharge gas 275 is diffused through the space of the tube body 410, thereby uniformizing the pressure of the discharge gas 275 in the discharge spaces 270 divided by the space dividing walls 300.

An impurity gas such as carbon monoxide (CO), nitrogen ($N_2$), carbon dioxide ($CO_2$), oxygen ($O_2$), water vapor ($H_2O$), etc. may be disposed in the discharge spaces 270 of the lamp body 200. These can be disposed alone or in a mixture thereof. When the impurity gas is reacted with the mercury (Hg), the amount of the mercury (Hg) in the discharge spaces 270 is decreased, so that the lifetime of the surface light source device 100 is also decreased.

A getter 425 is disposed inside the tube body 410 with the amalgam part 420 so as to increase the lifetime of the surface light source device 100. The getter 425 continuously adsorbs the impurity gas such as carbon monoxide (CO), nitrogen ($N_2$), carbon dioxide ($CO_2$), oxygen ($O_2$), water vapor ($H_2O$), etc. These can be adsorbed alone or in a mixture thereof. The getter 425 may comprise a zirconium-aluminum (Zr—Al) alloy. The getter 425 continuously adsorbs the impurity gas to increase the lifetime of the surface light source device 100.

The amalgam part 420 and the getter 425 may be mixed together and disposed inside the tube body 410. Alternatively, the amalgam part 420 and the getter 425 may also form a multi-layered structure.

The voltage applying part 500 applies voltage to each of the discharge spaces 270 so as to generate the invisible light. The invisible light passes through the fluorescent layer 260 to form the visible light. The voltage applying part 500 includes a first electrode 510 and a second electrode 520.

The first and second electrodes 510 and 520 may be disposed in the discharge spaces 270. Alternatively, only one of the first and second electrodes 510 and 520 may be disposed in the discharge spaces 270. The first and second electrodes 510 and 520 may also be disposed outside the lamp body 200. Preferably, the first and second electrodes 510 and 520 are disposed outside the lamp body 200, and the first electrode 510 is spaced apart from the second electrode 520. When the first and second electrodes 510 and 520 are disposed outside the lamp body 200, the discharge voltage and power consumption of the surface light source device may be decreased.

According to the present embodiment, the space dividing walls 300 are disposed in the lamp body 200 having the first substrate 210, the second substrate 220 and the sealant 230, and the discharge gas supplying member 400 is fixed to the space dividing walls 300, so that the pressure of the discharge gas disposed in the discharge spaces 270 formed by the space dividing walls 300 becomes uniform, thereby uniformizing the luminance of the surface light source device 100. In addition, the impurity gas disposed in the discharge spaces 270 is adsorbed so as to increase the lifetime of the surface light source device 100.

Figure 4:
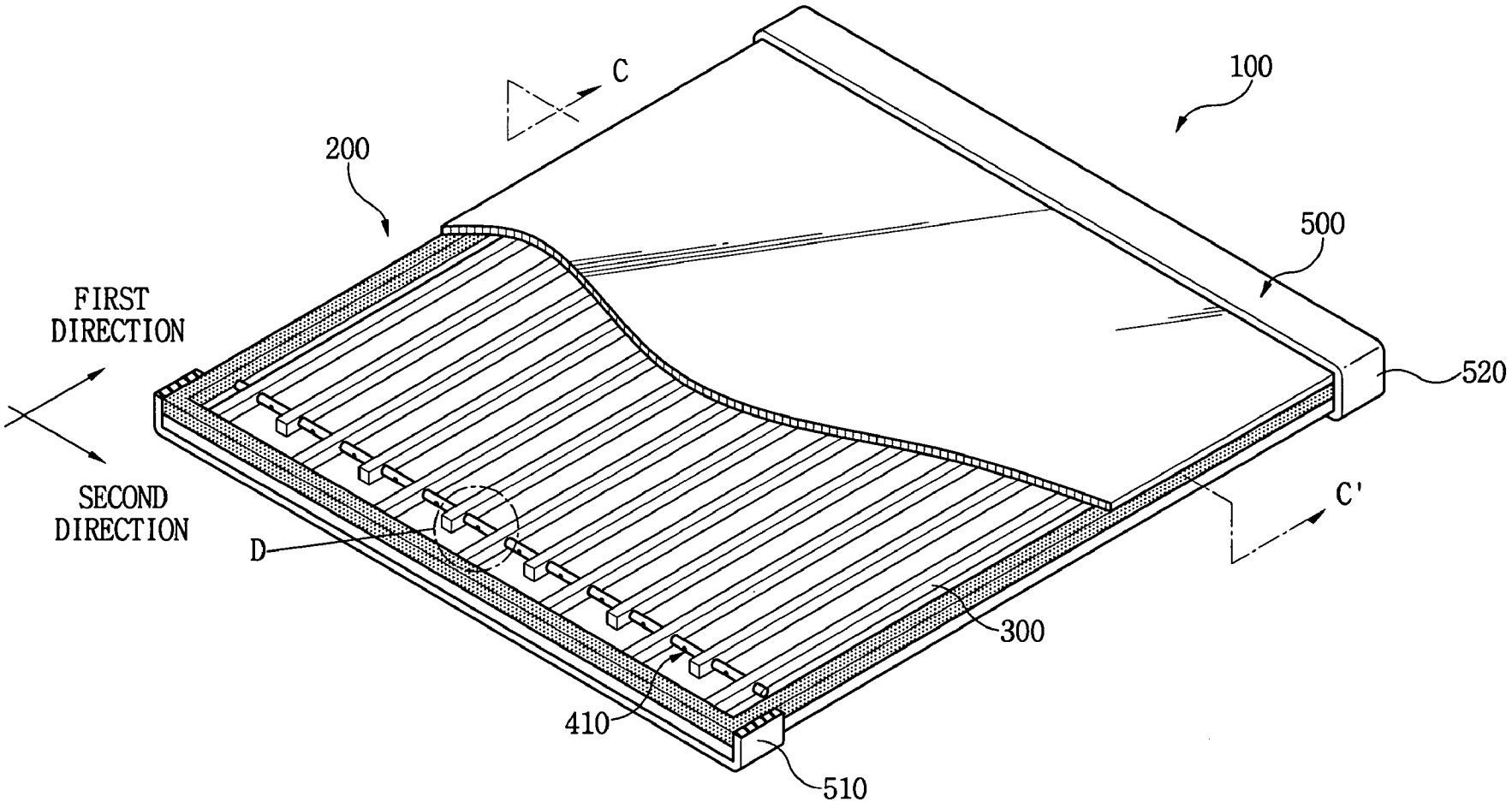
FIG. 4 is a partially cut out perspective view showing a surface light source device in accordance with another exemplary embodiment of the present invention.
Figure 5:
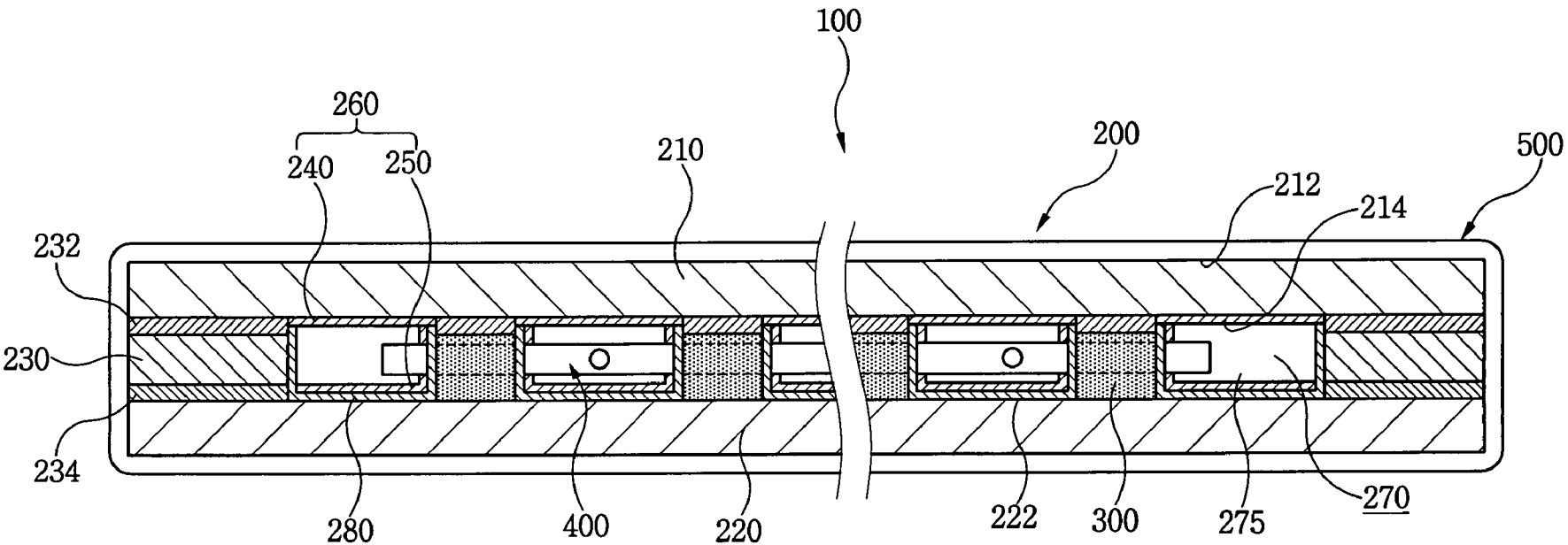
FIG. 5 is a cross-sectional view taken along a line C–C' of FIG. 4.

FIG. 4 is a perspective view, partially in cross-sectional view form, showing a surface light source device in accordance with another exemplary embodiment of the present invention. FIG. 5 is a cross-sectional view taken along a line C–C' of FIG. 4, and FIG. 6 is an enlarged view showing a portion 'D' of FIG. 4.

Figure 6:
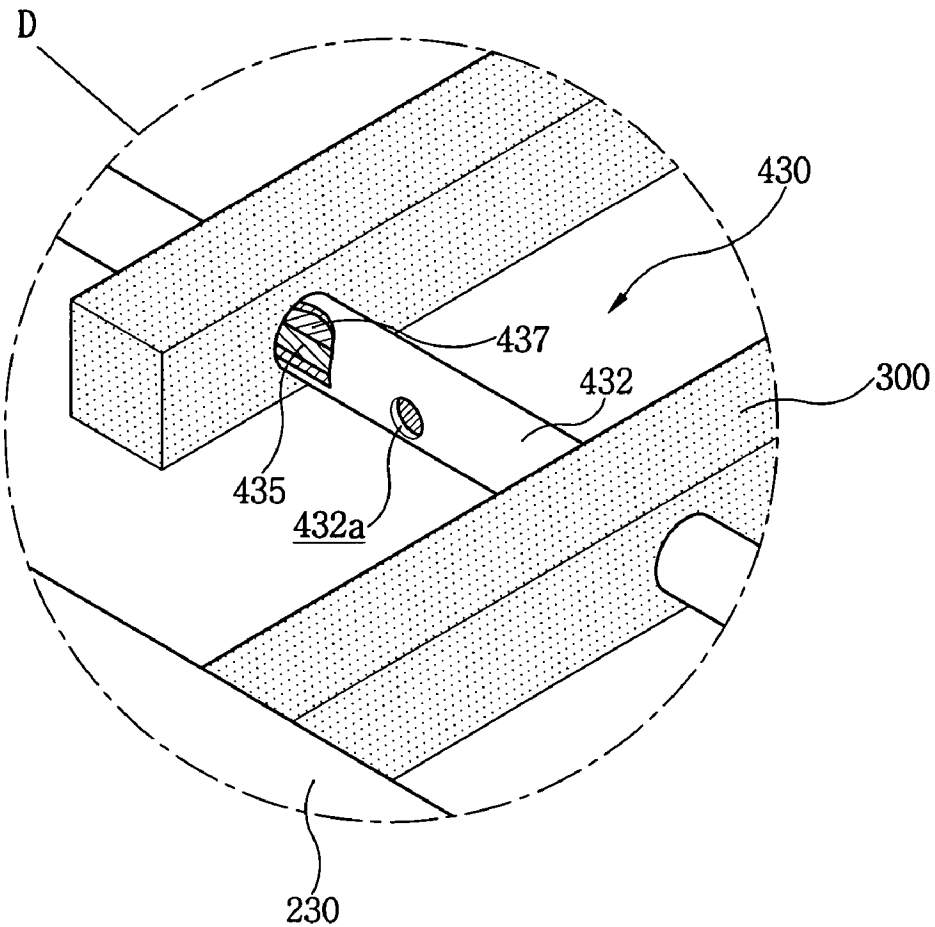
FIG. 6 is an enlarged perspective view showing a portion 'D' of FIG. 4.

The surface light source device of FIGS. 4 to 6 is same as in FIGS. 1 to 3 except for a discharge gas supplying member. Thus, the same reference numerals will be used to refer to the same or like parts as those described in FIGS. 1 to 3 and any further explanation will be omitted.

Referring to FIGS. 4 to 6, the discharge gas supplying members 430 are disposed to pass through a plurality of space dividing walls 300 that are arranged in a first direction, and the discharge gas supplying members 430 are arranged in a second direction that is substantially perpendicular to the first direction. Each of the discharge gas supplying members 430 passes through a plurality of the space dividing walls 300 so that the discharge gas supplying member 430 is fixed to the space dividing walls 300. Preferably, each of the discharge gas supplying members 430 passes through all of the space dividing walls 300 disposed in the lamp body 200.

The discharge gas supplying member 430 includes a tube body 432 and an amalgam part 437. The tube body 432 has a tubular shape having a throughhole 432*a*, and end portions of the tube body 432 are opened. The throughhole 432*a* is disposed between the space dividing walls 300. Preferably, at least one of the throughholes 432*a* may be disposed between the space dividing walls 300 adjacent to one another. The discharge gas 275 disposed in the amalgam part 437 is diffused into discharge spaces 270 through the throughholes 432*a*. The discharge spaces 270 are formed by the space dividing walls 300.

The tube body 432 may further include a getter 435. The getter 435 continuously adsorbs the impurity gas such as carbon monoxide (CO), nitrogen ($N_2$), carbon dioxide ($CO_2$), oxygen ($O_2$), water vapor ($H_2O$), etc. These can be adsorbed alone or in a mixture thereof. The getter 435 may comprise a zirconium-aluminum (Zr—Al) alloy. The getter 435 continuously adsorbs the impurity gas to increase the lifetime of the surface light source device 100.

Therefore, the space dividing walls 300 are disposed in the lamp body 200 having the first substrate 210, the second substrate 220 and the sealant 230, and the discharge gas supplying member 430 having the throughhole 432*a* is fixed to the space dividing walls 300, so that the pressure of the discharge gas disposed in each of the discharge spaces 270 formed by the space dividing walls 300 becomes uniform, thereby uniformizing the luminance of the surface light source device 100. In addition, the impurity gas disposed in the discharge spaces 270 is adsorbed to increase the lifetime of the surface light source device 100.

Figure 7:
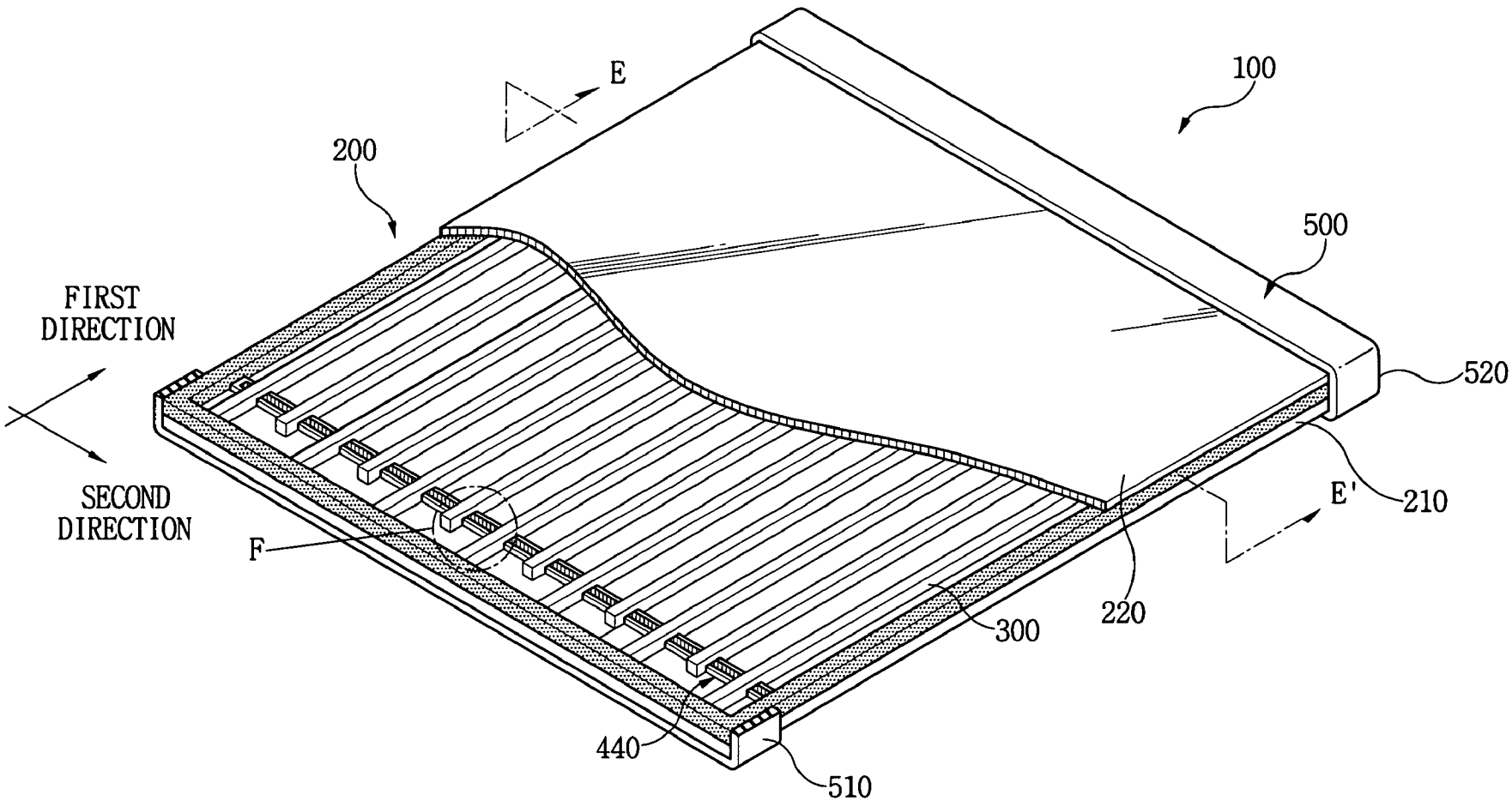
FIG. 7 is a partially cut out perspective view showing a surface light source device in accordance with another exemplary embodiment of the present invention.
Figure 8:
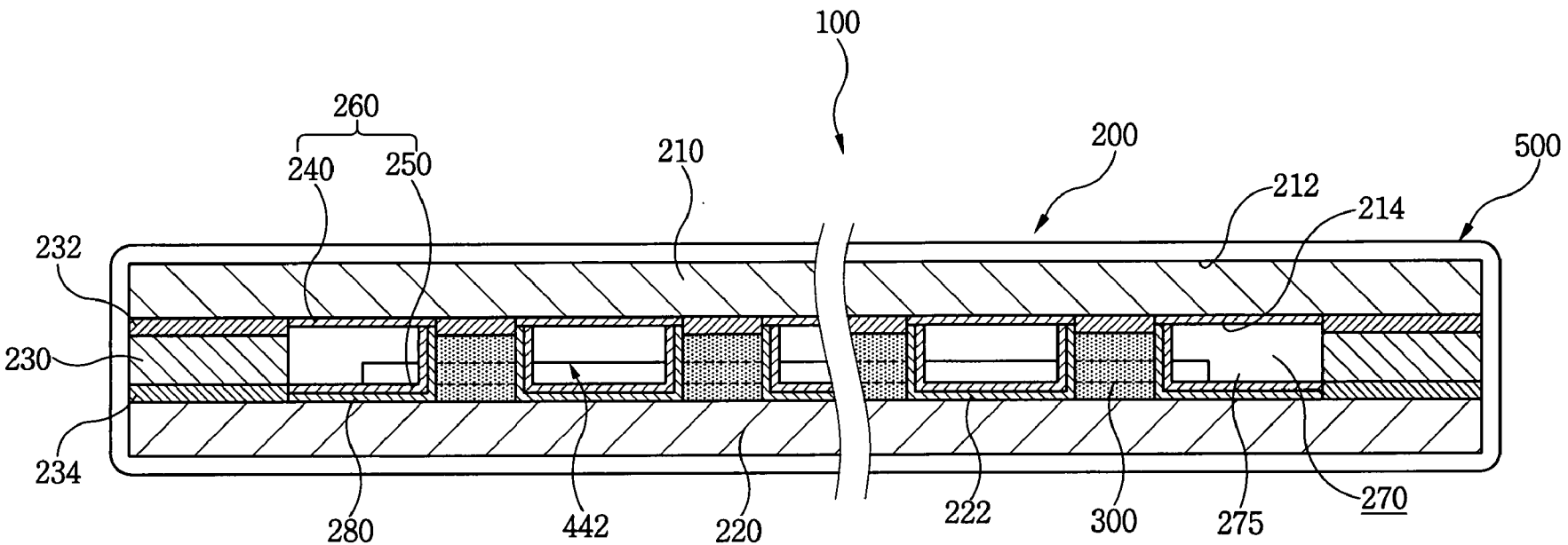
FIG. 8 is a cross-sectional view taken along a line E–E' of FIG. 7.

FIG. 7 is a partially cut out perspective view showing a surface light source device in accordance with another exemplary embodiment of the present invention. FIG. 8 is a cross-sectional view taken along line E–E' of FIG. 7, and FIG. 9 is an enlarged view showing a portion 'F' of FIG. 7.

Figure 9:
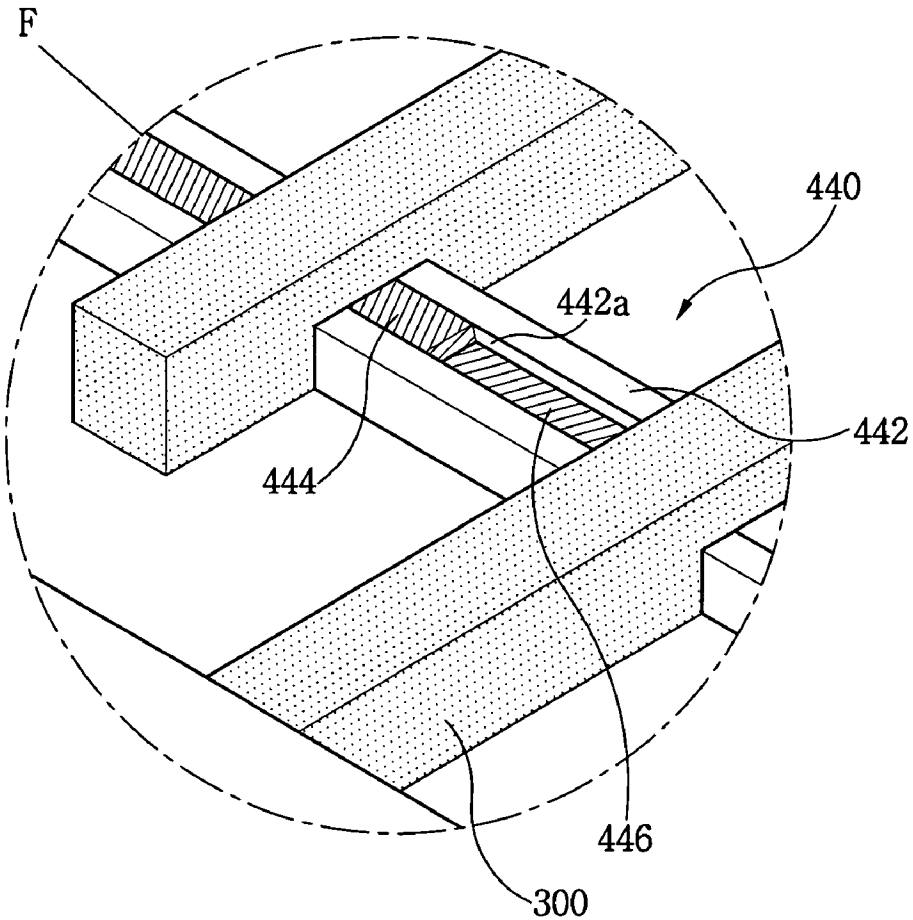
FIG. 9 is an enlarged view showing a portion 'F' of FIG. 7.

The light source device of FIGS. 7 to 9 is same as in FIGS. 1 to 3 except for a discharge gas supplying member. Thus, the same reference numerals will be used to refer to the same or like parts as those described in FIGS. 1 to 3 and any further explanation will be omitted.

Referring to FIGS. 7 to 9, the discharge gas supplying member 440 is disposed to pass through space dividing walls 300, and arranged in a second direction. The space dividing walls 300 are arranged in a first direction. The discharge gas supplying member 440 passes through all of the space dividing walls 300 disposed in a lamp body 200.

The discharge gas supplying member 440 includes a tray 442, an amalgam part 444. The tray 442 has an extended rectangular parallelepiped shape having an extended groove 442*a*. The tray 442 and the groove 442*a* are extended in the second direction. The amalgam part 444 is disposed in the receiving groove 442*a*. The receiving groove 442*a* passes through all of the space dividing walls 300. The amalgam part 444 disposed in the receiving groove 442*a* is heated to supply discharge spaces 270 with a discharge gas 275. The discharge spaces 270 are formed by the space dividing walls 300.

A getter 446 may be disposed in the tray 442 with the amalgam part 444. The getter 446 continuously adsorbs an impurity gas, for example, such as carbon monoxide (CO), nitrogen ($N_2$), carbon dioxide ($CO_2$), oxygen ($O_2$), water vapor ($H_2O$), etc. These can be adsorbed alone or in a mixture thereof. The getter 446 may comprise a zirconium-aluminum (Zr—Al) alloy. The amalgam part 444 and the getter 446 may be mixed together, and disposed in the tray 442. Alternatively, the amalgam part 444 and the getter 446 may also form a multi-layered structure. The getter 446 continuously absorbs the impurity gas, so that the lifetime of the surface light source device 100 is increased.

The tray 442 that has the extended rectangular parallelepiped shape is disposed to pass through at least two space dividing walls 300. The space dividing walls 300 are disposed in a lamp body 200. The lamp body 200 includes a first substrate 210, a second substrate 220 and a sealant 230. The tray 442 is fixed to the amalgam part 444 and the discharge gas supplying member 440. The discharge gas supplying member 440 supplies the discharge spaces 270 formed by the space dividing walls 300 with the discharge gas 275 to uniformize the luminance of the surface light source device 100. In addition, the getter 446 absorbs the impurity gas to improve lifetime of the surface light source device 100.

Figure 10:
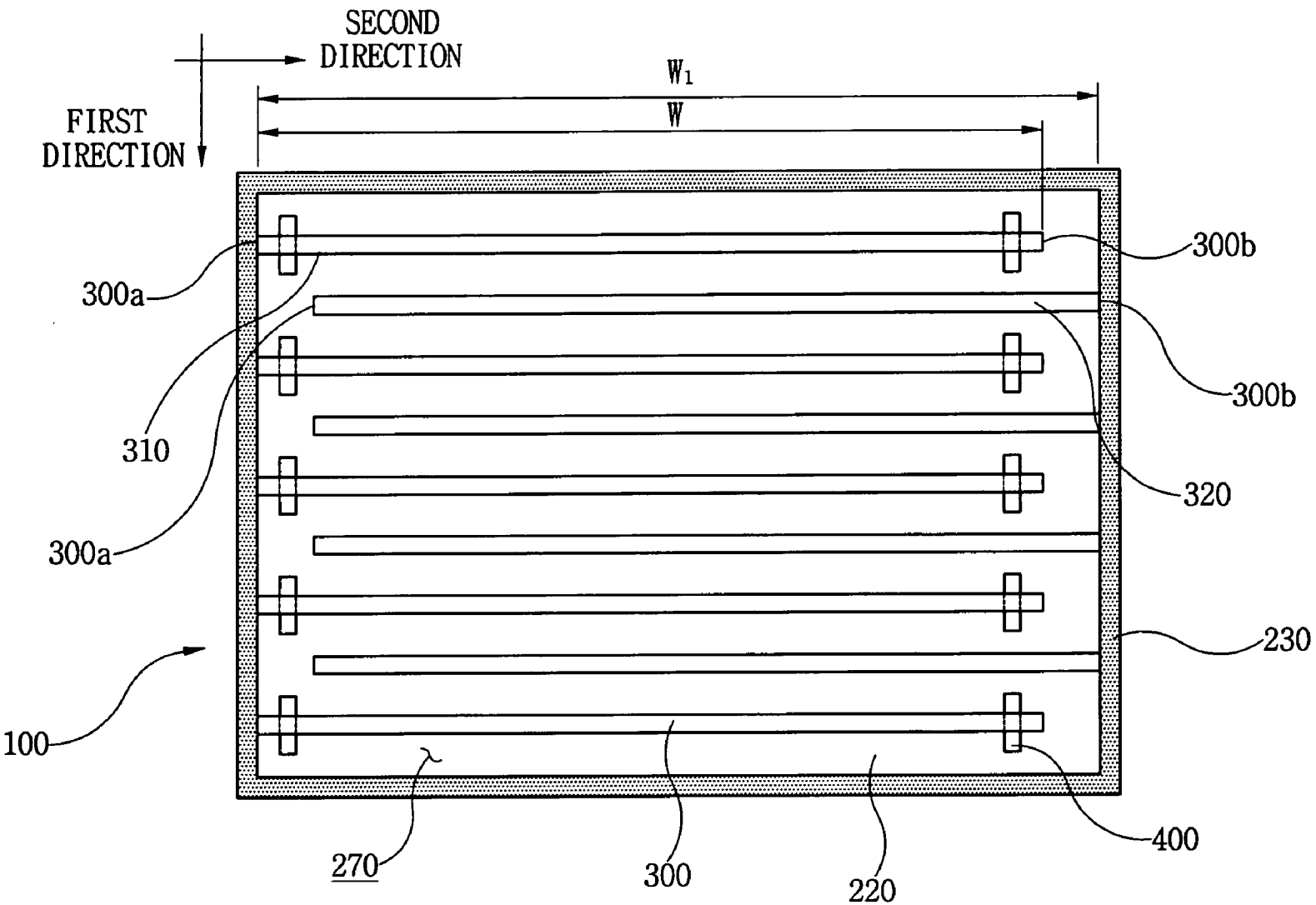
FIG. 10 is a plan view showing a space dividing wall of a surface light source device in accordance with another exemplary embodiment of the present invention.

FIG. 10 is a plan view showing a space dividing wall of a surface light source device in accordance with another exemplary embodiment of the present invention.

The light source device of FIG. 10 is same as in FIGS. 1 to 3 except for a space dividing walls. Thus, the same reference numerals will be used to refer to the same or like parts as those described in FIGS. 1 to 3 and any further explanation will be omitted.

Referring to FIG. 10, the space dividing walls 300 are disposed on a second substrate 220, and extended in a first direction. The space dividing walls 300 are parallelly arranged in a second direction that is substantially perpendicular to the first direction. The length W of the space dividing walls 300 is substantially equal to one another. The length W of the space dividing walls 300 is shorter than the distance W1 between the inner walls of the sealants 230 that are disposed in the first direction. The space dividing walls 300 include first end portions 300*a* and second end portions 300*b*.

The first end portions 300*a* of odd numbered space dividing walls 300 make contact with the sealant 230, and the second end portions 300*b* of even numbered space dividing walls 300 make contact with the sealant 230 to form discharge spaces 270 having a serpentine shape on the second substrate 220.

The pressure distribution of discharge gas in the discharge spaces 270 having the serpentine shape is uniform. Therefore, the surface light source device 100 generates a light having uniform luminance. In addition, the discharge gas supplying member 400 disposed to pass through the space dividing walls 300 uniformizes the discharge gas in the discharge spaces 270 to improve the uniformity of the luminance and to increase the lifetime of the surface light source device 100.

Figure 11:
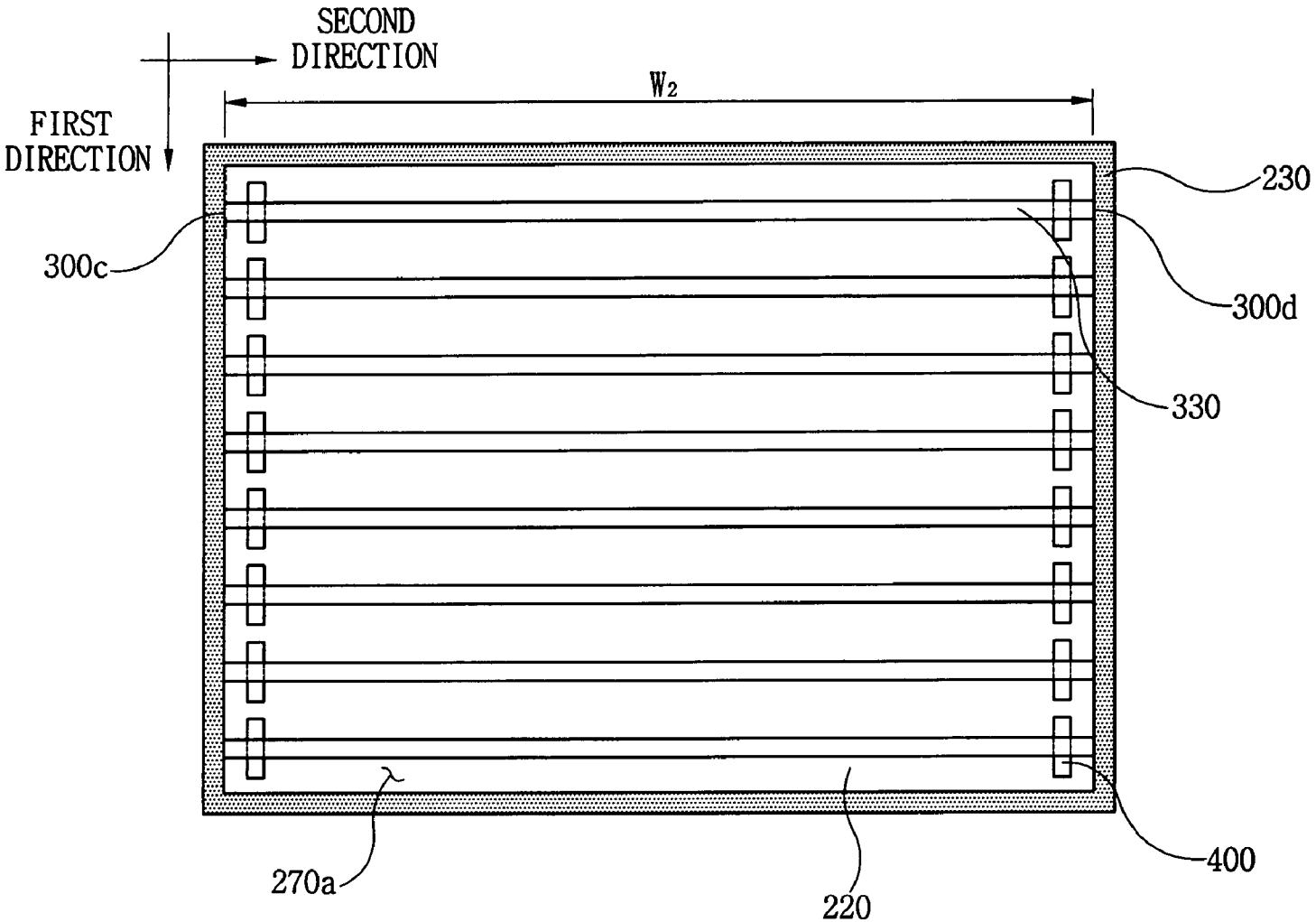
FIG. 11 is a plan view showing a space dividing wall of a surface light source device in accordance with another exemplary embodiment of the present invention.

FIG. 11 is a plan view showing a space dividing wall of a surface light source device in accordance with another exemplary embodiment of the present invention.

The light source device of FIG. 11 is same as in FIGS. 1 to 3 except for space dividing walls. Thus, the same reference numerals will be used to refer to the same or like parts as those described in FIGS. 1 to 3 and any further explanation will be omitted.

Referring to FIG. 11, the space dividing walls 330 are extended in a first direction, and disposed on a second substrate 220. The space dividing walls 330 are parallelly arranged in a second direction that is substantially perpendicular to the first direction. The length W1 of the space dividing walls 330 is substantially equal to one another. The length W1 of the space dividing walls 330 is substantially equal to the distance W2 between the inner walls of the sealants 230 that are arranged in the first direction. The space dividing walls 330 include first end portions 300*c* and second end portions 300*d*.

The first and second end portions 300*c* and 300*d* make contact with the sealant 230 to form discharge spaces 270*a* separated from one another. The discharge spaces 270*a* are disposed on a second substrate 220. The separated discharge spaces 270*a* prevent the rapid change of the density of electrically unstable discharge gas. The discharge gas supplying member 400 disposed to pass through the space dividing walls 330 uniformizes the pressure of the discharge gas of the separated discharge spaces 270*a*.

According to the present embodiment, although the discharge spaces 270*a* are separated from one another by the space dividing walls 330, the discharge gas may be supplied to the separated discharge space 270*a* through the discharge gas supplying member 400, thereby uniformizing the pressure of the separated discharge space 270*a*.

Figure 12:
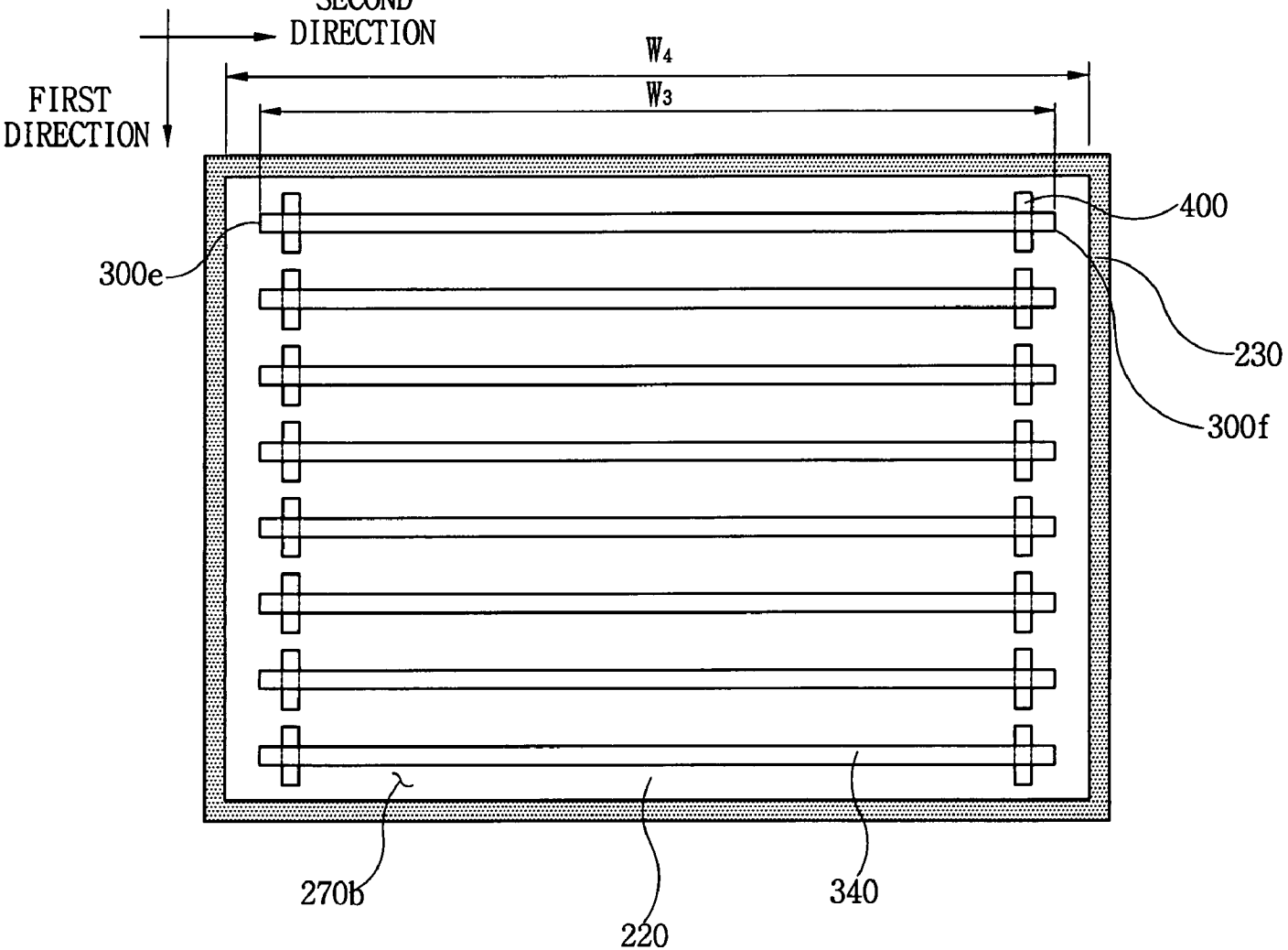
FIG. 12 is a plan view showing a space dividing wall of a surface light source device in accordance with another exemplary embodiment of the present invention.

FIG. 12 is a plan view showing a space dividing wall of a surface light source device in accordance with another exemplary embodiment of the present invention.

The light source device of FIG. 12 is same as in FIGS. 1 to 3 except for space dividing walls. Thus, the same reference numerals will be used to refer to the same or like parts as those described in FIGS. 1 to 3 and any further explanation will be omitted.

Referring to FIG. 12, the space dividing walls 340 are extended in a first direction, and disposed on a second substrate 220. The space dividing walls 340 are parallelly arranged in a second direction that is substantially perpendicular to the first direction. The length W3 of the space dividing walls 340 is substantially equal to one another. The length W3 of the space dividing walls 340 is shorter than the distance W4 between the inner walls of the sealants 230 that are arranged in the first direction. The space dividing walls 340 include first end portions 300*e* and second end portions 300*f*.

The first and second end portions 300*e* and 300*f* are spaced apart from the sealant 230 to uniformize the distribution of discharge gas disposed in discharge space 270*b*, thereby improving the uniformity of the luminance. The discharge gas supplying member 400 disposed to pass through the space dividing walls 340 uniformizes the pressure distribution of the discharge gas in the discharge spaces 270*b*, and improves the lifetime of the surface light source device.

FIGS. 13A to 13H are cross-sectional views showing a method of manufacturing a surface light source device in accordance with another exemplary embodiment of the present invention.

The light source device of FIGS. 13A to 13H is the same as in FIGS. 1 to 3. Thus, the same reference numerals will be used to refer to the same or like parts as those described in FIGS. 1 to 3 and any further explanation will be omitted.

Figure 13A:
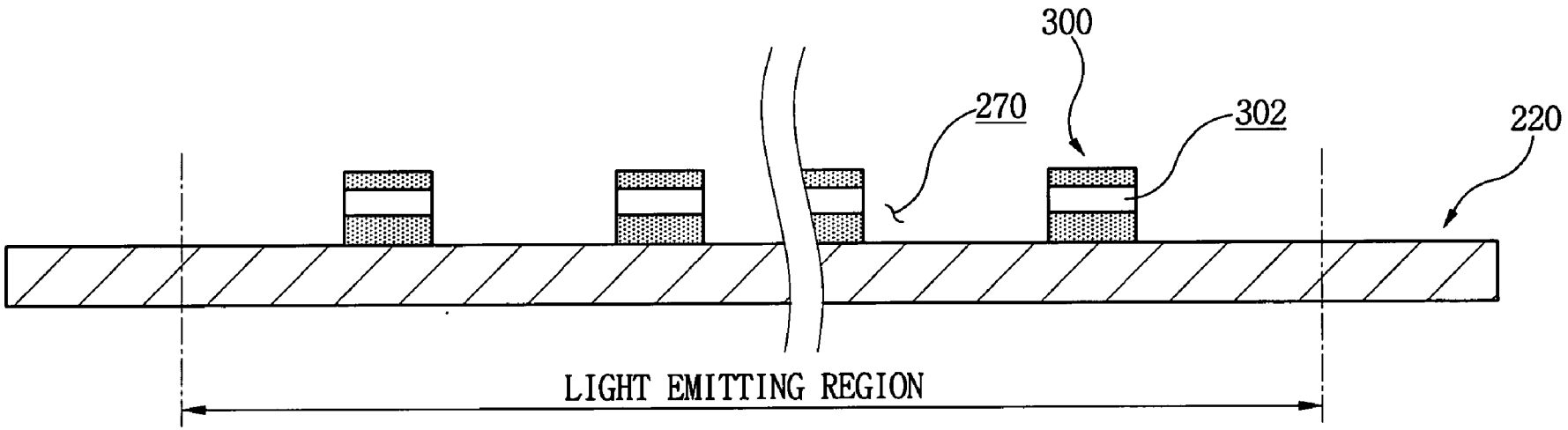
FIGS. 13A to 13H are cross-sectional views showing a method of manufacturing a surface light source device in accordance with another exemplary embodiment of the present invention.

Referring to FIG. 13A, a second substrate 220 having a rectangular plate shape includes a light emitting region. A plurality of space dividing walls 300 are disposed in the light emitting region, and extended in a first direction. The light emitting region is divided by the space dividing walls 300 to form a plurality of discharge spaces 270.

A transparent fluid material or an opaque fluid material is coated in the light emitting region as a band shape to form the space dividing walls 300. Alternatively, the transparent fluid material and the opaque fluid material may be stacked to form a multi-layered structure.

A throughhole 302 is formed in the space dividing walls 300 in a second direction. Each of the space dividing walls 300 may include a plurality of the throughholes 302.

Figure 13B:
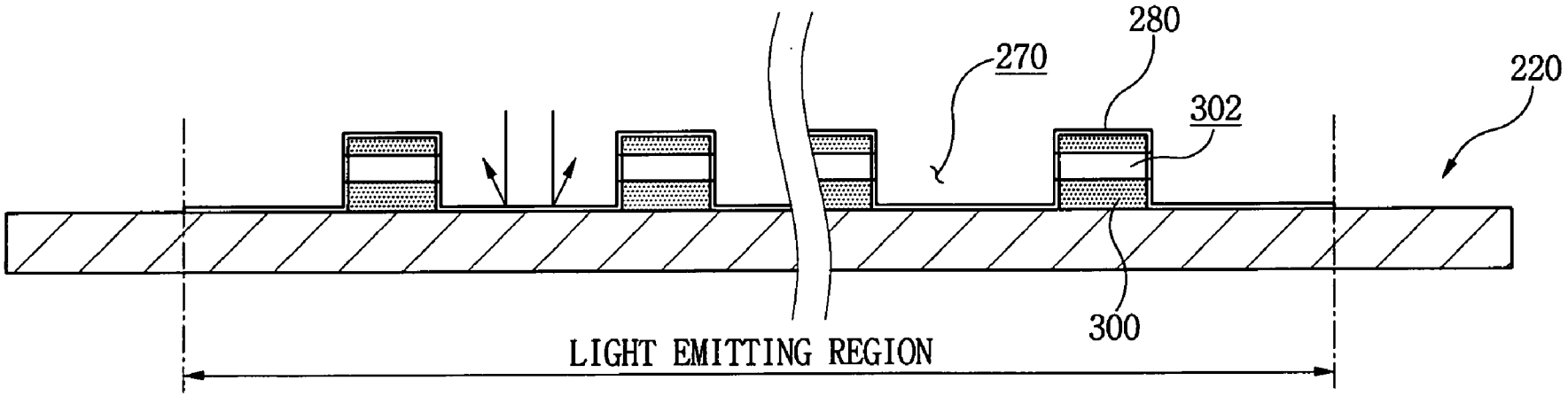

Referring to FIG. 13B, titanium oxide ($TiO_3$) or aluminum oxide ($Al_2O_3$) is deposited on the second substrate 220 to form a light reflecting layer 280 having high reflectivity. The light reflecting layer 280 may be formed through a sputtering process or a chemical vapor deposition process. The light that is generated from a discharge gas of the discharge spaces 270 is reflected on the light reflecting layer 280 so as to increase the luminance of the surface light source device 100.

Figure 13C:
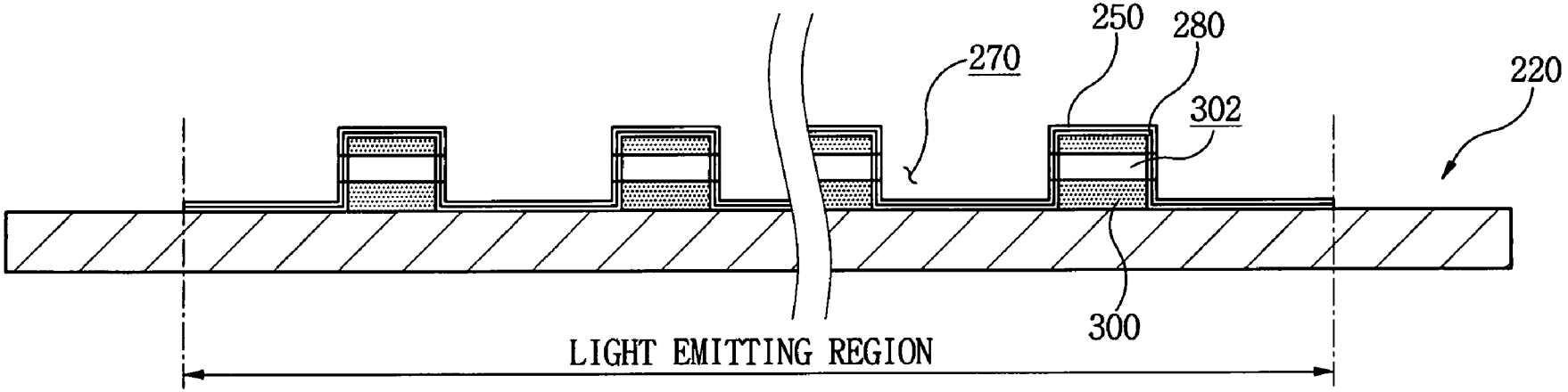

Referring to FIG. 13C, a red fluorescent material, a green fluorescent material and a blue fluorescent material are coated on the light reflecting layer 280 to form a second fluorescent layer 250. The amount of the red, green and blue fluorescent materials are adjusted, such that the amounts of the red light, green light and blue light are substantially equal to one another. The ultraviolet light generated from the discharge gas of the discharge spaces 270 passes through the fluorescent layer 250 to form a visible light. The red, green and blue fluorescent materials may be coated through a spraying process. The ultraviolet light passes through the red, green and blue fluorescent materials to form red, green and blue light, respectively.

Figure 13D:
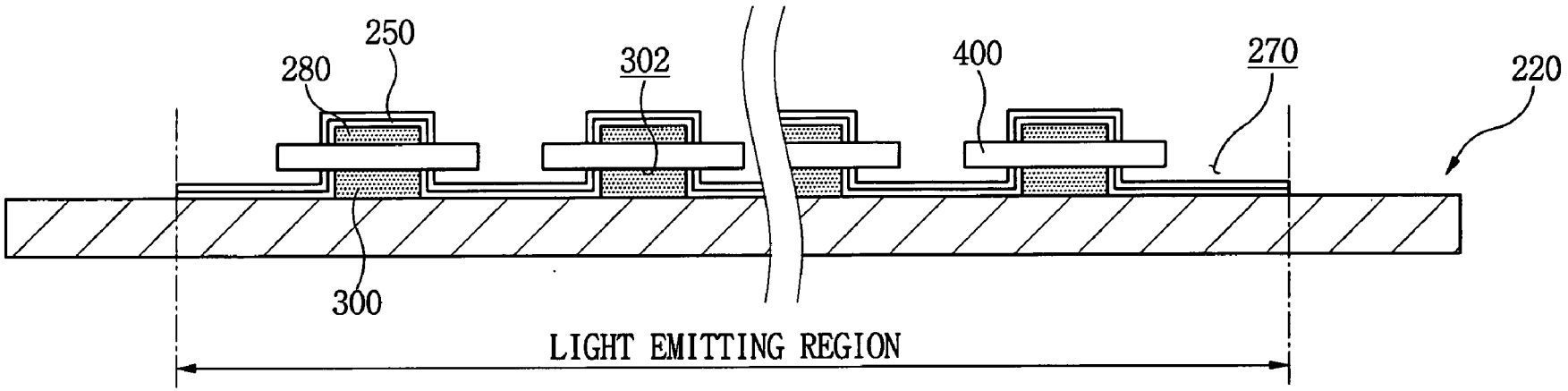

Referring to FIG. 13D, a discharge gas supplying member 400 is inserted into each of the throughholes 302 formed in the space dividing walls 300. The discharge gas supplying member 400 includes an amalgam part and a getter. The amalgam part supplies a mercury vapor at a temperature ranged from about 700° C. to about 900° C. The getter adsorbs an impurity gas such as carbon monoxide (CO), nitrogen ($N_2$), carbon dioxide ($CO_2$), oxygen ($O_2$), water vapor ($H_2O$), etc. These can be adsorbed alone or in a mixture thereof. The amalgam part and the getter may be mixed together. Alternatively, the amalgam part and the getter may also form a multi-layered structure.

Figure 13E:
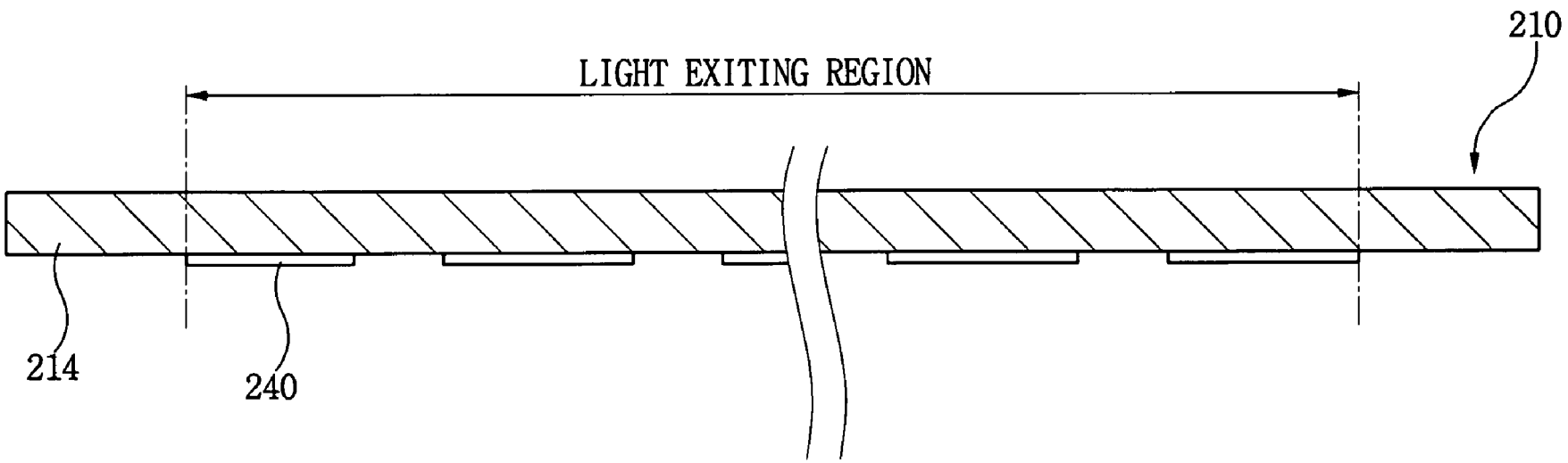

Referring to FIG. 13E, a first substrate 210 corresponding to the second substrate 220 includes a light exiting region corresponding to the light emitting region. A first fluorescent layer 240 is disposed in the light exiting region of the first substrate 210.

The first fluorescent layer 240 is formed on a portion of a second face 214 of the first substrate 210. The first fluorescent layer 240 may be printed on the first substrate 210. The first fluorescent layer 240 may not be formed on the second face 214 corresponding to the space dividing wall 300.

The first fluorescent layer 240 includes the red, green and blue fluorescent materials. The amount of the red, green and blue fluorescent materials are adjusted, such that the amounts of the red light, green light and blue light are substantially equal to one another. The ultraviolet light generated in the discharge spaces 270 passes through the red, green and blue fluorescent materials to form red, green and blue light, respectively.

Figure 13F:
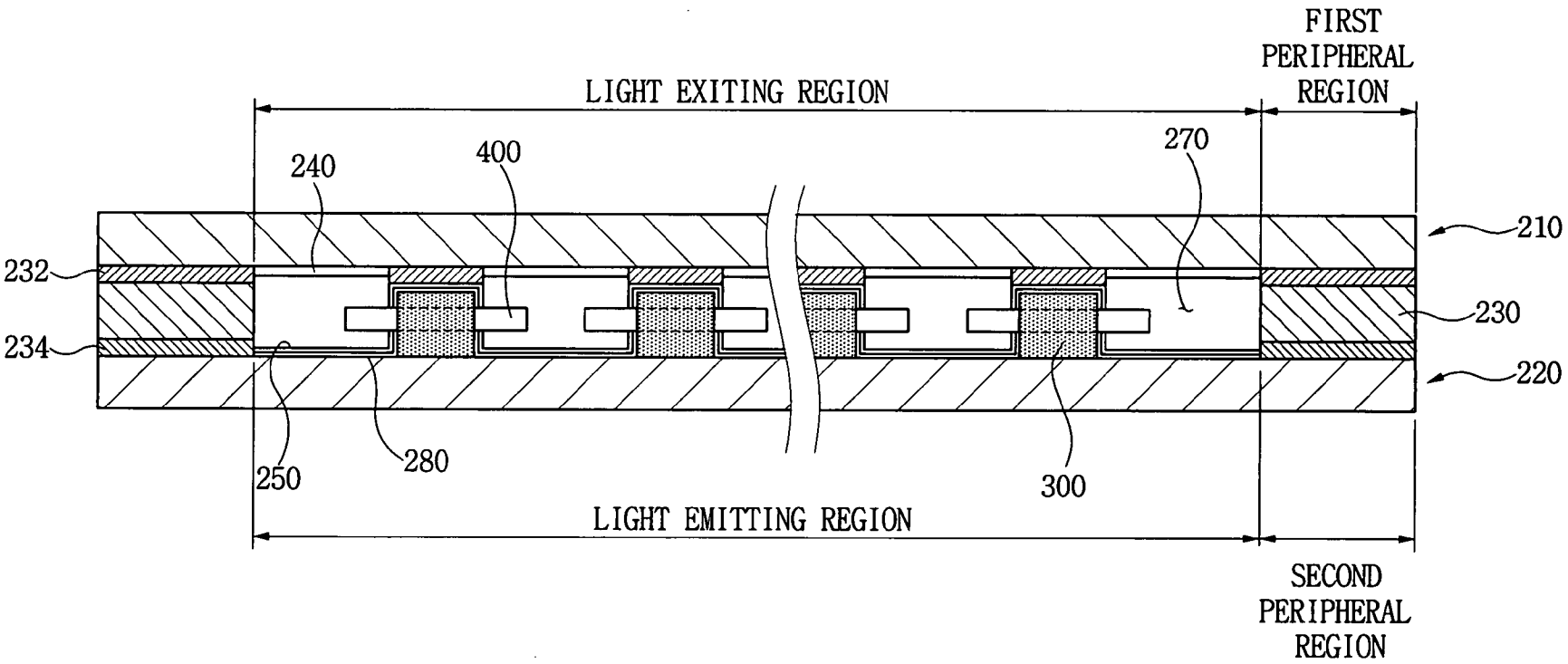

Referring to FIG. 13F, the first substrate 210 is combined with the second substrate 220 through a sealant 230. The sealant 230 is disposed in a first peripheral region that surrounds the light exiting region of the first substrate 210, and disposed in a second peripheral region that surrounds the light emitting region of the second substrate 220. A first adhesive 232 is disposed between the sealant 230 and the first substrate 210, and disposed between the space dividing walls 300 and the first substrate 210. A second adhesive 234 is disposed between the sealant 230 and the second substrate 220. Therefore, the first and second adhesives 232 and 234 combine the first substrate 210, the sealant 230 and the second substrate 220 to form a lamp body.

Figure 13G:
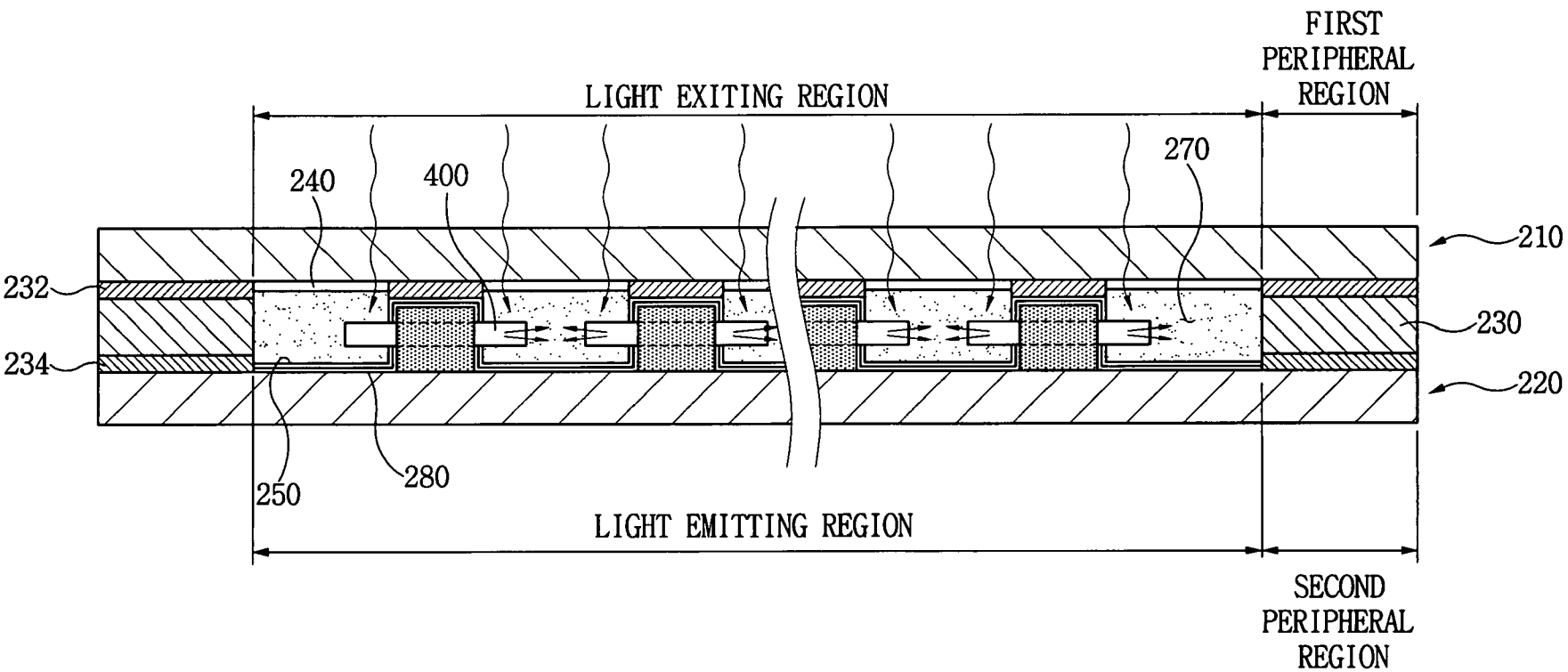

Referring to FIG. 13G, the discharge gas supplying member 400 in the lamp body is heated by a radio frequency at a temperature ranged from about 700° C. to about 900° C. When the discharge gas supplying member 400 is heated, an amalgam part of the discharge gas supplying member 400 supplies mercury vapor. The supplied mercury vapor may exist in the discharge space 270 to be in a liquid state or in a gas state. When the mercury vapor is diffused into the discharge spaces 270, a getter absorbs an impurity gas of the discharge space 270. The impurity gas includes carbon monoxide (CO), nitrogen ($N_2$), carbon dioxide ($CO_2$), oxygen ($O_2$), water vapor ($H_2O$), etc. These can be used alone or in a mixture thereof.

The lamp body is then heated at a temperature ranged from about a room temperature to about 150° C. for no more than about one hour, so that the mercury vapor in the lamp body is dispersed, thereby uniformizing the distribution of the discharge gas 270. Therefore, the luminance of the surface light source device 100 becomes uniform, and the lifetime of the surface light source device 100 is increased.

Figure 13H:
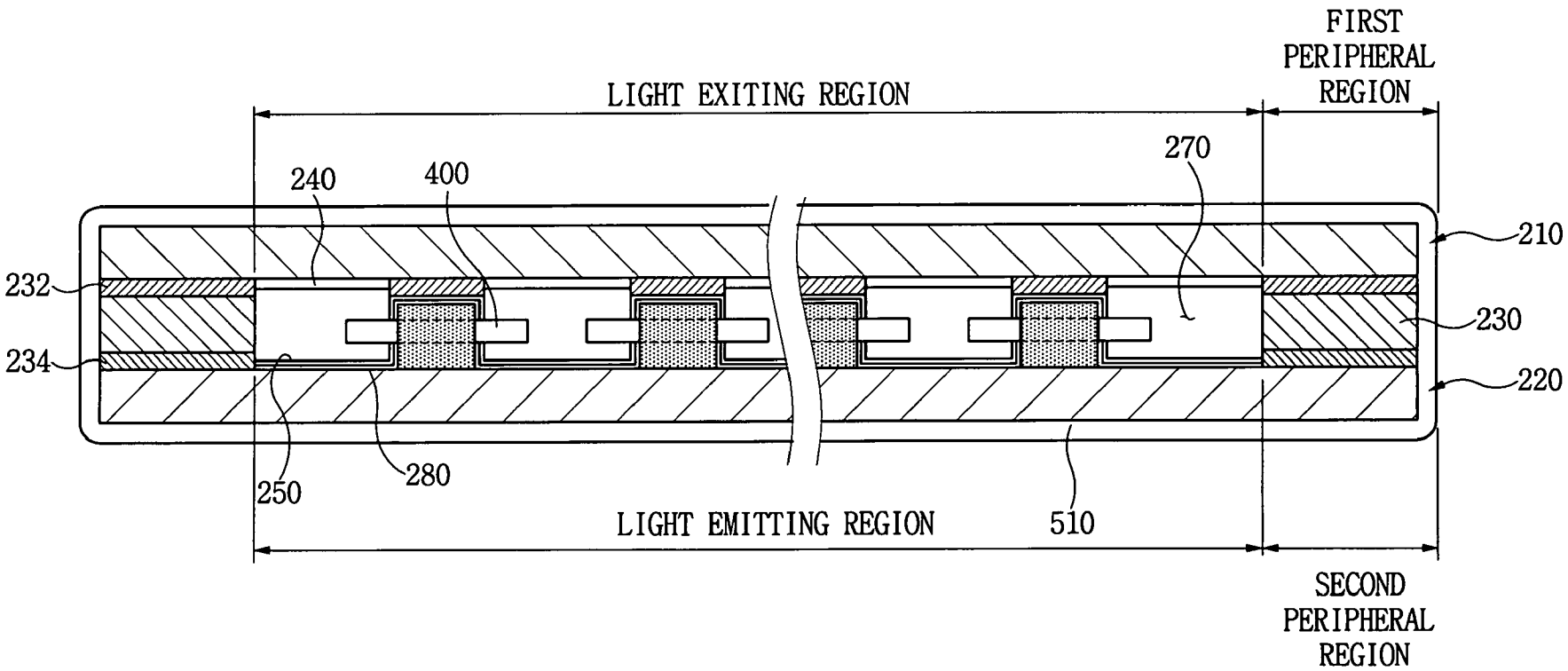

Referring to FIG. 13H, a first electrode 510 and a second electrode 520 are disposed on the outer surface of the lamp body. The first electrode 510 is spaced apart from the second electrode 520, and the first and second electrodes 510 and 520 have a band shape. The first and second electrodes 510 and 520 surround the lamp body. A discharge voltage is applied to the first and second electrodes 510 and 520 so that the discharge gas in the lamp body is discharged, thereby forming the ultraviolet light. The ultraviolet light passes through the fluorescent layer to form the visible light.

Figure 14:
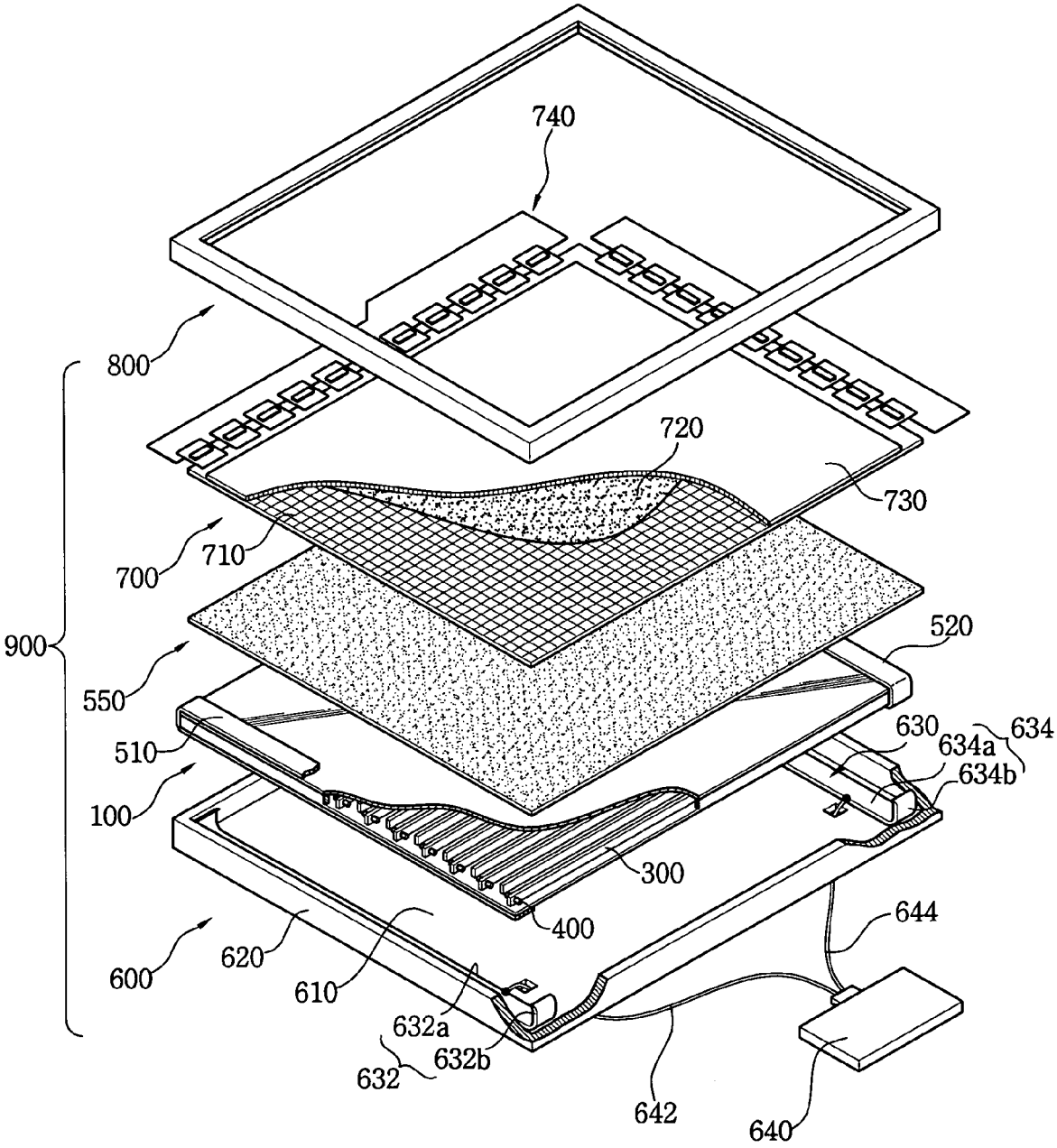
FIG. 14 is an exploded and partially cut out perspective view showing an LCD apparatus in accordance with another exemplary embodiment.

FIG. 14 is an exploded and partially cut out perspective view showing an LCD apparatus in accordance with another exemplary embodiment.

The light source device of FIG. 14 is the same as in FIGS. 1 to 3. Thus, the same reference numerals will be used to refer to the same or like parts as those described in FIGS. 1 to 3 and any further explanation will be omitted.

Referring to FIG. 14, the LCD apparatus 900 includes a receiving container 600, a surface light source device 100, an LCD panel 700 and a chassis 800.

The receiving container 600 includes a bottom surface 610, a plurality of sidewalls 620, a discharge voltage applying module 630 and an inverter 240. The sidewalls 620 are disposed on edge of the bottom surface 610 to form a receiving space. The receiving container 600 fixes the surface light source device 100 and the LCD panel 700 so as to prevent the drifting of the surface light source device 100 and the LCD panel 700.

The size of the bottom surface 610 is no smaller than that of the surface light source device 100. The shape of the bottom surface 610 is substantially equal to that of the surface light source device 100. The bottom surface 610 and the surface light source device 100 have a rectangular parallelepiped plate shape.

The discharge voltage applying module 630 applies a discharge voltage to a voltage applying part 500 of the surface light source device 100. The discharge voltage applying module 630 includes a first discharge voltage applying portion 632 and a second discharge voltage applying portion 634. The first discharge voltage applying portion 632 includes a first conductive body 632*a* and a first conductive clips 632*b* disposed on the end portions of the first conductive body 632*a*. The second discharge voltage applying portion 634 includes a second conductive body 634*a* and second conductive clips 634*b* disposed on the end portions of the second conductive body 634*a*.

The surface light source device 100 may include a plurality of the discharge voltage applying modules 630. The discharge voltage applying modules 630 disposed on the end portions of the surface light source device 100 are gripped by the first and second conductive clips 632*b* and 634*b*. The discharge voltage applying modules 630 is fixed to the receiving container 600.

The inverter 640 applies the discharge voltage to the first and second discharge voltage applying portions 632 and 634. The inverter 640 is electrically connected to the first and second discharge voltage applying portions 632 and 634 through a first voltage applying line 642 and a second voltage applying line 644, respectively.

The surface light source device 100 includes a lamp body 200, space dividing walls 300, a discharge gas supplying member 400 and a voltage applying part 500. The lamp body 200 includes a space that has a flat shape. The discharge gas supplying member 400 is disposed to pass through at least one of the space dividing walls 300. The discharge gas supplying member 400 provides the space in the lamp body 200 with a discharge gas. The discharge gas is discharged to form an invisible light. The voltage applying part 500 that is disposed outside the lamp body 200 applies the discharge voltage. The invisible light passes through a fluorescent material of the surface light source device 100 so as to form a visible light.

The LCD panel 700 converts the visible light generated from the surface light source device 100 to an image light containing an information. The LCD panel 700 includes a thin film transistor (TFT) substrate 710, a liquid crystal 720, a color filter substrate 730 and a driving module 740.

The TFT substrate 710 includes a plurality of pixel electrodes arranged in a matrix shape, a TFT applying a driving voltage to each of the pixel electrodes, a plurality of gate lines and a plurality of data lines.

The color filter substrate 730 includes a plurality of color filters and a common electrode disposed on the color filter. The color filters are disposed on the TFT substrate 710, and correspond to the pixel electrodes.

The liquid crystal 720 is interposed between the TFT substrate 710 and the color filter substrate 730.

The chassis 800 surrounds the edge of the color filter substrate 730. A portion of the chassis 800 is hooked on the receiving container 600. The chassis 800 prevents the breakage of the LCD panel 700 that is fragile and the drifting of the LCD panel 700. A light diffusion plate 550 is disposed between the surface light source device 100 and the LCD panel.

According to the present invention, the lifetime of the surface light source device generating a planar light is increased, and the luminance of the light is uniformized so that the display quality of an image is improved.

This invention has been described with reference to the exemplary embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A surface light source device comprising:

a lamp body that includes a flat shaped space and a fluorescent layer disposed in the flat shaped space to convert an invisible light into a visible light;

a space dividing member that divides the flat shaped space into a plurality of discharge spaces;

a discharge gas supplying member disposed to pass through the space dividing member and fixed to the space dividing member, and to supply the discharge spaces with a discharge gas that generates the invisible light; and a voltage applying part that applies a discharge voltage to the discharge gas.

2. The surface light source device of claim 1, wherein the lamp body comprises:

a first substrate that includes a first face emitting the visible light and a second face corresponding to the first face;

a second substrate that includes a third face that faces the second face; and a sealant disposed along the edges of the second and third faces to form the flat shaped space between the first and second substrates.

3. The surface light source device of claim 2, wherein the sealant comprises a rectangular frame shape disposed along the edges of the first and second substrates.

4. The surface light source device of claim 3, further comprising:

a first adhesive disposed between the sealant and the second face; and a second adhesive disposed between the sealant and the third face.

5. The surface light source device of claim 2, further comprising:

a first fluorescent portion disposed on the second face to convert the invisible light into the visible light; and a second fluorescent portion disposed on exposed portion of the space dividing member and the third face to convert the invisible light into the visible light.

6. The surface light source device of claim 5, farther comprising a light reflecting layer disposed under the second fluorescent portion.

7. The surface light source device of claim 1, wherein the voltage applying part comprises a first electrode disposed outside the lamp body and a second electrode disposed outside the lamp body.

8. The surface light source device of claim 1, wherein the discharge gas supplying member is disposed to pass through one of the space dividing members.

9. The surface light source of claim device 8, wherein the discharge gas supplying member comprises a tube body and aii amalgam part disposed in the tube body to supply a mercury vapor.

10. The surface light source device of claim 9, wherein the discharge gas supplying member further comprises a getter disposed in the tube body to adsorb an impurity gas disposed in the lamp body, and the impurity gas is any one selected from the group consisting of carbon monoxide (CO), nitrogen ($N_2$), carbon deride ($CO_2$), oxygen ($O_2$), water vapor ($H_2O$) and a mixture thereof.

11. The surface light source device of claim 1, wherein the discharge gas supplying member is disposed to pass through a plurality of the space dividing members, and the discharge gas supplying member includes a tube body having a throughhole formed between the space dividing members, and an amalgam part disposed in the tube body to supply a mercury vapor.

12. The surface light source device of claim 11, wherein the discharge gas supplying member further comprises a getter disposed in the tube body to adsorb an impurity gas disposed in the lamp body, and the impurity gas is any one selected from the group consisting of carbon monoxide (CO), nitrogen ($N_2$), carbon dioxide ($CO_2$), oxygen ($O_2$), water vapor ($H_2O$) and a mixture thereof.

13. The surface Ught source device of claim 1, wherein the discharge gas supplying member is disposed to pass through a plurality of the space dividing members, and the discharge gas supplying member includes a tray having a receiving groove and an amalgam part disposed in the receiving groove to supply a mercury vapor.

14. The surface light source device of claim 13, wherein the discharge gas supplying member further comprises a getter disposed in the tube body to adsorb an impurity gas disposed in the lamp body, and the impurity gas is any one selected from the group consisting of carbon monoxide (CO), nitrogen ($N_2$), carbon dioxide ($CO_2$), oxygen ($O_2$), water vapor ($H_2O$) and a mixture thereof.

15. The surface light source device of claim 2, wherein a length of the space dividing members is substantially the same as one another;

the space dividing members are substantially parallel with one another; and first end portions of odd numbered space dividing members and second end portions of even numbered space dividing members opposite to the first end portions make contact with first inner face of the sealant and second inner face of the sealant opposite to the first inner face, respectively to form a discharge space having a serpentine shape.

16. The surface light source device of claim 2, wherein first and second end portions of the space dividing members make contact with first inner face of the sealant and second inner face of the sealant opposite to the first inner face to divide the flat shaped space to form a plurality of separated discharge spaces.

17. The surface light source device of claim 2, wherein the space dividing members are substantially parallel with one another, and first end portions and second end portions of the space dividing members are spaced apart from the sealant.

18. The surface light source device of claim 1, wherein the discharge gas supplying member is disposed at a position corresponding to the voltage applying part.

19. A liquid crystal display (LCD) apparatus comprising:

a surface light source device including a lamp body that includes a flat shaped space and a fluorescent layer disposed in the flat shaped space to convert an invisible light into a visible light, a space dividing member that divides the flat shaped space into a plurality of discharge spaces, a discharge gas supplying member that is disposed to pass through the space dividing member and fixed to the space dividing member, and to supply the discharge spaces with a discharge gas tat generates the invisible light, and a voltage applying pan that applies a discharge voltage to the discharge gas;

a receiving container that receives the surface light source device; and an LCD panel that converts the visible light into an image light including an information.

20. The LCD apparatus of claim 19, wherein the lamp body comprise:

a first substrate that includes a first face emitting the visible light and a second face corresponding to the first face;

a second substrate that includes a third face opposite to the second face; and a sealant disposed along edges of the second and third faces so as to form the flat shaped space between the first and second substrate.

21. The LCD apparatus of claim 20, wherein a, length of the space dividing members is substantially equal to one another;

the space dividing members are substantially parallel with one another; and first end portions of odd numbered space dividing members and second end portions of even numbered space dividing members opposite to the first end portions respectively make contact with first inner face of the sealant and second inner face of the sealant opposite to the first inner face so as to form a discharge space having a serpentine shape.

22. The LCD apparatus of claim 20, wherein first and second end portions of the space dividing members respectively make contact with first inner face of the sealant and second inner face of the sealant opposite to the first inner Lace so as to divide the flat shaped space to form a plurality of separated discharge spaces.

23. The LCD apparatus of claim 20, wherein the space dividing members are substantially parallel with one another, and first end portions and second end portions of the space dividing members are spaced span from the sealant.

* * * * *